United States Patent [19]

Hettinger, Jr. et al.

[11] Patent Number: 4,515,680

[45] Date of Patent: May 7, 1985

[54] NAPHTHENIC LUBE OILS

[75] Inventors: William P. Hettinger, Jr., Russell, Ky.; Frank H. Turrill, Huntington, W. Va.; George J. Rozman; H. Wayne Beck, both of Ashland, Ky.

[73] Assignee: Ashland Oil, Inc., Ashland, Ky.

[21] Appl. No.: 494,739

[22] Filed: May 16, 1983

[51] Int. Cl.[3] ..... C10G 55/00; C10G 55/02

[52] U.S. Cl. ..... 208/87; 208/89; 208/108; 208/92

[58] Field of Search ..... 208/87, 89, 108, 216 R

[56] References Cited

U.S. PATENT DOCUMENTS

| | | | |
|---|---|---|---|
| Re. 30,529 | 2/1981 | Reynolds . | |
| 2,800,433 | 7/1957 | Read | 208/80 X |
| 3,012,963 | 12/1961 | Archibald | 208/217 |
| 3,142,635 | 7/1964 | Coonradt et al. | 208/111 |
| 3,232,863 | 2/1966 | Watson et al. | 208/36 |
| 3,272,734 | 9/1966 | MacLaren | 208/89 X |
| 3,376,214 | 4/1968 | Bertolacini et al. | 208/89 X |
| 3,425,932 | 2/1969 | Surrena et al. | 208/143 |
| 3,438,887 | 4/1969 | Morris et al. | 208/87 |
| 3,520,796 | 7/1970 | Murphy et al. | 208/33 |
| 3,562,149 | 2/1971 | Bryson et al. | 208/143 |
| 3,617,473 | 11/1971 | Lipscomb | 208/97 X |
| 3,617,476 | 11/1971 | Woodle | 208/36 |
| 3,619,414 | 11/1971 | Mills et al. | 208/133 |
| 3,637,483 | 1/1972 | Carey | 208/86 |
| 3,663,422 | 5/1972 | Dun et al. | 208/86 |
| 3,663,423 | 5/1972 | Bennett et al. | 208/59 |
| 3,663,427 | 5/1972 | Thomas | 208/87 |
| 3,668,113 | 6/1972 | Burbidge et al. | 208/97 |
| 3,702,817 | 11/1972 | Cummins et al. | 208/87 |
| 3,730,876 | 5/1973 | Sequeira | 208/59 |
| 3,779,896 | 12/1973 | Woodle | 208/86 |
| 3,923,636 | 12/1975 | Mead et al. | 208/58 |
| 3,968,023 | 7/1976 | Yan | 208/86 |
| 4,003,956 | 1/1977 | Hilfman | 585/270 |
| 4,137,148 | 1/1979 | Gillespie et al. | 208/87 |
| 4,357,232 | 11/1982 | Holland et al. | 208/87 |

FOREIGN PATENT DOCUMENTS

| | | |
|---|---|---|
| 14602 | 2/1977 | Japan . |
| 1088933 | 10/1967 | United Kingdom . |
| 1134015 | 11/1968 | United Kingdom . |
| 1560036 | 1/1980 | United Kingdom . |

*Primary Examiner*—Delbert E. Gantz
*Assistant Examiner*—Glenn A. Caldarola
*Attorney, Agent, or Firm*—Richard C. Willson, Jr.; Richard L. Kelly

[57] ABSTRACT

A process is disclosed for increasing the volume of lubricating oil base stocks recovered from a crude oil. A fraction having an atmospheric boiling range of about 675° to 1100° F. is recovered by vacuum distillation. This fraction is treated with furfural to extract a hydrocarbon mixture containing at least 50 volume % aromatic hydrocarbons. The raffinate is a lubricating oil base stock very high in paraffinic hydrocarbons and low in naphthenic hydrocarbons. The fraction extracted by the furfural contains at least about 50 volume % aromatic hydrocarbons and less than about 10 volume % paraffinic hydrocarbons. The mixture is hydrotreated to hydrogenate a substantial portion of the aromatic hydrocarbons. The hydrotreated product then is catalytically dewaxed. After removal of low boiling components, the finished lubricating oil base stock has a viscosity of at least about 200 SUS at 100° F., a pour point of less than 20° F. and contains at least 50 volume % of naphthenic hydrocarbons, a maximum of about 40 volume % aromatic hydrocarbons, and a maximum of about 10 volume % paraffinic hydrocarbons.

11 Claims, 1 Drawing Figure

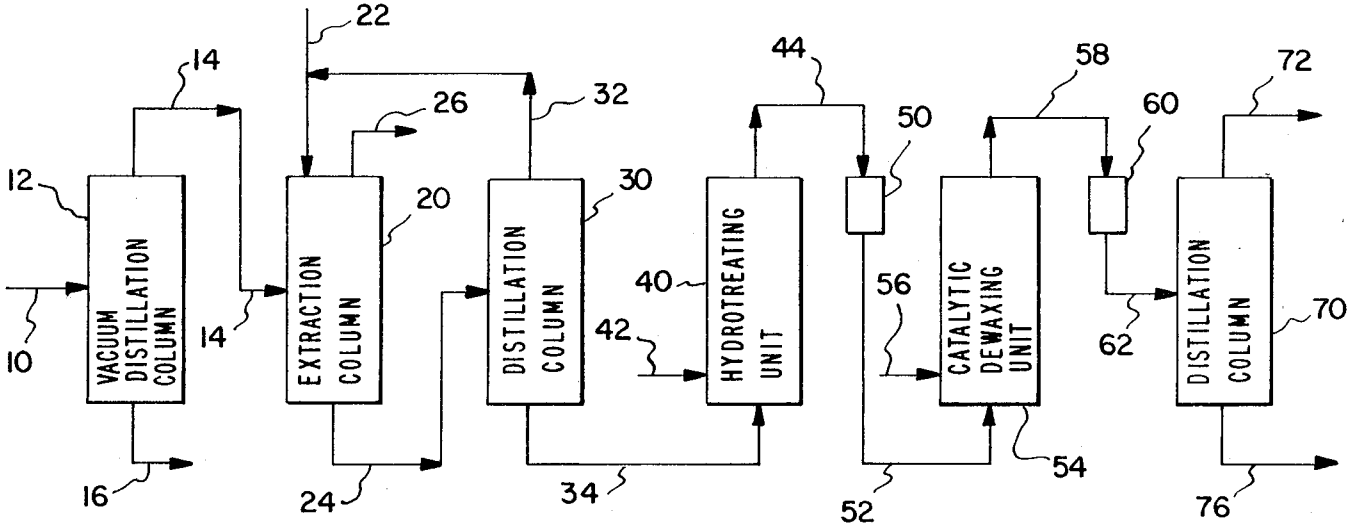
VACUUM DISTILLATION COLUMN
EXTRACTION COLUMN
DISTILLATION COLUMN
HYDROTREATING UNIT
CATALYTIC DEWAXING UNIT
DISTILLATION COLUMN
10
12
14
14
16
20
22
24
26
30
32
34
40
42
44
50
52
54
56
58
60
62
70
72
76

NAPHTHENIC LUBE OILS

BACKGROUND OF THE INVENTION

Petroleum based lubricating oils are mixtures of liquid hydrocarbons having a requisite viscosity for proposed end use lubrication applications. As terminology has been developed in the art, lubricating oils frequently are classified as either naphthenic lubricating oils or paraffinic lubricating oils.

By a generally accepted consensus, paraffinic lubricating oils have a hydrocarbon content containing at least about 50 volume % paraffinic hydrocarbons and less than about 25 volume % naphthenic hydrocarbons. Such lubricating oils also may contain small to modest concentrations of aromatic hydrocarbons, and heterocyclic compounds. The oil also will contain lubricating oil additives. By a similar consensus, naphthenic lubricating oils have a hydrocarbon content made up of at least about 30 volume % naphthenic hydrocarbons, with the balance of the hydrocarbons being predominantly aromatic hydrocarbons, but which also may contain small to moderate quantities of paraffinic hydrocarbons and heterocyclic compounds. The oil also will contain lubricating oil additives.

Historically, naphthenic lubricating oils have been the lubricating oils of choice on a cost/performance basis. This has been particularly the case in formulating highly viscous oils used in heavy duty applications such as railroad and marine diesel engines. It has been the experience in the art that the naphthenic lubricating oils have the capability of dissolving and/or softening significant quantities of the semi-solid carbonacous decomposition products which form in crank cases under severe operating conditions. The semi-solid carbonacous components formed on the cylinder walls and suspended in naphthenic lubricating oil in the crank cases of diesel engines tend to be softer than the corresponding carbonacous products formed in paraffinic lubrication oils under identical operating conditions. By reason of their softer nature, the deposites formed from naphthenic lubricating oils cause less wear on moving engine parts. It is the belief in the art that diesel engines have a longer operating life when lubricated with naphthenic lubricants than is the case with paraffinic lubricants. Specifically, it is believed that the incidence of piston ring breakage is lower when naphthenic lubricating oils are employed.

By a quirk of nature, naturally occurring crude oil containing significant fractions of naphthenic hydrocarbons in the lubricating oil range are found largely within the continental United States and Venezuela. Crude oils produced in other oil producing areas of the world have relatively lower concentrations of such naphthenic hydrocarbons. Accordingly, as the worldwide demand for naphthenic lubricating oils is increasing, the available supply of crude oils containing significant concentrations of the desired naphthenic hydrocarbons is decreasing. It is thus seen that a shortage of naphthenic lubricating oils is developing.

For the above reasons, there is a need in the art for developing processes to enhance the volume of naphthenic lubricating oils that can be produced from existing crude oil supplies.

SUMMARY OF THE INVENTION

The invention is directed to a process in which the yield of naphthenic lubricating oil base stock from a crude oil is enhanced. In a more specific embodiment of the invention, a refinery stream distillate having an atmospheric boiling point range of about 675°-1100° F. and consisting predominately of paraffinic hydrocarbons, but containing smaller quantities of naphthenic hydrocarbons, aromatic hydrocarbons and heterocyclic compounds is treated with a heterocyclic solvent such as furfural to extract therefrom a hydrocarbon mixture containing the bulk of the aromatic hydrocarbons, and the heterocyclic compounds originally present in said refinery stream. This extracted hydrocarbon mixture then is subjected to hydrotreating under superatmospheric hydrogen pressure in the presence of a hydrogenation catalyst to hydrogenate the aromatic rings of a substantial portion of the aromatic hydrocarbons to form a stock substantially enriched in naphthenic hydrocarbons. The hydrotreated product then is treated with hydrogen under superatmospheric pressure in the presence of a dewaxing catalyst to remove the bulk of the wax-like components present in the hydrotreated stock. Finally, the light low-boiling aliphatic hydrocarbons are removed from the dewaxed product by distillation and a lubricating oil base stock is recovered which is high in naphthenic hydrocarbons, typically containing at least 50 volume % naphthenic hydrocarbons.

The raffinate recovered in the solvent extraction step is stripped free of any residual extracting solvent and processed into a paraffinic lubricating oil base stock having a high viscosity index. Thus, it is seen that the process of the invention provides maximum usage of the naphthenic and aromatic hydrocarbons present in the crude for conversion to high value products by providing two lubricating oil base stocks from a single crude, one base stock being rich in naphthenic hydrocarbons and the other rich in paraffinic hydrocarbons.

BRIEF DESCRIPTION OF THE DRAWINGS

The single drawing is a schematic process flow sheet illustrating the practice of the invention.

DETAILED DESCRIPTION OF THE INVENTION

Referring to the process flow sheet set forth in the FIGURE, a reduced crude stream consisting of products having an atmospheric boiling point above about 650° F. is fed via line 10 to a vacuum distillation column 12. An overhead distillate is recovered via line 14. The overhead stream will have a boiling point range (corrected to atmospheric pressure) of about 675° to 1100° F. It will be recognized that the overhead distillate can be separated into several fractions of narrower boiling point ranges where desired. The bottoms fraction is recovered via line 16 for further processing.

The distillate from line 14 is fed to a counter current liquid-liquid solvent extraction column 20. An immiscible hetercyclic solvent such as furfural which serves as the extracting liquid is introduced into the top of column 20 via line 22. A liquid mixture containing the heterocyclic solvent together with the bulk of the aromatic hydrocarbons and heterocyclic compounds, and a portion of the naphthenic hydrocarbons originally present in the distillate from line 14 is recovered from the bottom of column 20 via line 24. The raffinate, consisting principally of aliphatic hydrocarbons, is recovered from the top of column 20 via line 26 for further processing.

The product exiting column 20 via line 24 is fed to distillation column 30. Column 30 is operated under temperature and pressure conditions such that essentially all of the heterocyclic solvent is recovered as an overhead fraction via line 32. This stream is recycled to line 22 for reintroduction into extraction column 20. The bottoms fraction from column 30 is recovered via line 34 and consists of a mixture containing at least about 50 volume % aromatic hydrocarbons, less than about 10 volume % paraffinic hydrocarbons, and a portion of the naphthenic hydrocarbons originally present in the refinery stream distillate. The mixture also will contain heterocyclic compounds including the heterocyclic extracting solvent not removed as overhead via line 32.

The stream from line 34 together with superatmospheric hydrogen from line 42 are introduced into a hydrotreating unit 40. Unit 40 will contain a catalyst of a type subsequently described. Unit 40, which can be either a fixed bed unit or a fluidized bed unit, is operated under temperature and pressure conditions such that a substantial portion of the aromatic hydrocarbons introduced via line 34 are hydrogenated. The product stream recovered via line 44 will contain at least about 50 volume % naphthenic hydrocarbons and less than about 40 volume % aromatic hydrocarbons. The product removed via line 44 is not yet suitable for use as a naphthenic lubricating oil base stock by reason of the fact that it contains too large a concentration of wax-like components.

The stream from line 44 is introduced into a processing unit 50 in which any catalyst particles carried overhead with the product are removed and the stream is adjusted to temperature and pressure conditions suitable for use in the next step of the process. The product recovered from unit 50 is transferred via line 52 to a catalytic dewaxing unit 54. Unit 54 can be either a fixed bed unit or a fluidized bed unit containing a dewaxing catalyst of a type subsequently described. Hydrogen is introduced by via line 56 and the temperature and pressure conditions within unit 54 are set to appropriate levels to catalytically convert a substantial portion of the wax-like components in stream 52 to lower boiling components, principally paraffinic in nature. The dewaxed stream is transferred via line 58 to a processing unit 60 in which any catalyst particles are removed and hydrogen is recycled to one or more of the upstream units via lines not shown.

The product stream from unit 60 is fed via line 62 to another distillation column 70. Low boiling components boiling below about 650° F. at atmospheric pressure are removed as an overhead fraction via line 72. This stream is used in products other than lubricants. The bottoms fraction is removed via line 76 and is a high quality naphthenic lubricating oil stock containing at least about 50 volume % naphthenic hydrocarbons, less than about 40 volume % of aromatic hydrocarbons, less than about 10 volume % of paraffinic hydrocarbons, and less than about 10 volume % of heterocyclic compounds. The product will have a pour point of less than about 20° F.

The viscosity of the product will be somewhat dependent upon the boiling point range of the fraction fed to extraction column 10. All of the finished naphthenic lubricating oil base stocks of the invention will have a minimum viscosity of at least about 200 SUS at 100° F., and usually in a range of about 250 to 700 SUS at 100° F. Depending upon the lubricating oil base stocks desired, the product recovered via line 76 can be vacuum stripped in a column not shown to remove lighter fractions to increase the base stock's viscosity to a range of about 700–1000 SUS at 100° F. and preferably to a range of about 800–900 SUS at 100° F. where a base stock is desired for formulation into a diesel engine lubricating oil.

The reduced crude introduced into the process via line 10 typically is a cut taken from a crude oil containing a small but significant concentration of aromatic hydrocarbons. The cut taken will be a relatively high boiling cut having an atmospheric boiling point above about 650° F. The precise operating conditions established for vacuum distillation column 12 will depend somewhat on the makeup of the reduced crude fed to the column. Typically, however, the column will be operated at pressures at the order of 25–125 mm Hg to recover an overhead fraction having a boiling point range (corrected to atmospheric pressure) of about 675° to about 1100° F.

The operating conditions employed in the liquid-liquid extraction unit 20 will be somewhat dependent upon the composition of the distillate introduced into the column via line 14. Typically, 2–3 volumes of heterocyclic solvent will be introduced through line 22 for each volume of distillate introduced via line 14. The raffinate stream recovered via line 26 will be intermittently or continuously analyzed by a suitable instrument such as a refractometer to assure that the conditions within column 20 are being maintained within proper operating ranges to control the desired composition of both the raffinate and the extracted hydrocarbon mixture. Temperatures in the range of about 145°–240° F. will be maintained within column 20 and, where necessary, the stream introduced via line 14 will be thermally conditioned by being passed through a suitable heat exchanger (not shown). Suitable heterocyclic solvents for use in the process include furfural, phenol, N-methyl pyrrolidone and the like. Furfural is the preferred solvent for ease of handling and proper separation of the charged feed stream.

Column 30 is shown as a single column as a part of the schematic flow sheet of the invention. In commercial practice, column 30 will have certain auxiliary units which work cooperatively therewith. As these are well known in the petroleum art, they are not illustrated. In a typical commercial operation, the furfural containing the highly aromatic extract from line 24 will be given an atmospheric flash, a medium pressure flash, a high pressure flash and a vacuum flash before entering column 30. The remainder of the furfural then will be stripped from the highly aromatic extract in column 30.

The aromatic hydrocarbon fraction recovered via line 34 is subjected to hydrotreating in unit 40, which can be either a fixed bed or a fluid bed type reactor. Reaction conditions are established so that the temperature is maintained within a range of about 620°–750° F. and preferrably 725°–750° F. with the pressure being maintained in a range of about 1500–2500 psi and preferably 2000 psi. While a wide variety of hydrotreating catalysts can be employed, it is preferred to employ a cobalt-molybdenum or a nickel-molybdenum catalyst. The catalyst can be and preferably is supported on a refractory inorganic oxide such as silica, alumina, magnesia, zeolites and the like. The throughput rate will be controlled to provide a liquid hourly space velocity (LHSV) in a range of about 0.25 to 1.0 and preferably about 0.5. A hydrogen charge of about 5,000 to 10,000

SCFB and preferably about 7,500 SCFB is employed. The conditions described above are sufficient to convert a substantial portion of the aromatic hydrocarbons to naphthenic hydrocarbons without causing excessive cleavage of naphthenic rings to form undesired paraffin hydrocarbons. A low level of hydrocracking will occur to form low boiling paraffinic hydrocarbons having boiling points below the boiling point range of the distillate recovered from column 12. These may be removed from the stream recovered from unit 40 via line 44, although normally such low boiling components will not be removed at this point in the process.

The hydrogenated product recovered from unit 40 is not suitable for use as a naphthenic lubricating oil base stock by reason of having an undesirably high concentration of waxy components. The waxy components are removed by subjecting the hydrogenated product to a catalytic dewaxing step in catalytic dewaxing unit 54. The catalytic dewaxing is carried out by subjecting the previously hydrogenated product to a further hydrogenation step employing different reaction conditions. Typical operating conditions in unit 54 are:

Temperature: 500°–1,000° F.
Pressure: 100–3,000 psig
LHSV: 0.1–10
Hydrogen/Hydrocarbon ($H_2$/HC v/v): 2,000–3,000 SCFB The catalyst employed typically will be a noble metal (particularly platinum or palladium) or a Group VI-B or Group VIII metal (including certain oxides and sulfides thereof) supported on an acidic zeolite support having a high silica-to-alumina mol ratio. Typical of the catalyst supports found to be suitable are the zeolites sold under the trade designation ZSM, particularly ZSM-5. These supports are crystalline alumina/silicate zeolites having a silica/alumina mol ratio of at least 12. They have pore sizes in the 2–5 angstroms size range. The hydrogenation component used with these supports typically is nickel, platinum and palladium. An especially preferred catalyst in platinum carried on a hydrogen mordenite support having its pores partially blocked with barium. With this catalyst, the preferred operating conditions are; temperature about 625° F., pressure about 1400 psi, hydrogen recyle rate about 2330 standard cubic feet per barrel (SCFB), and LHSV about 0.5.

The product recovered via line 58, after removal of low boiling components boiling below about 650° F., is a high quality naphthenic hydrocarbon lubricating oil based stock. Typically, it will contain at least about 50 volume % naphthenic hydrocarbons, less than about 10 volume % paraffinic hydrocarbons, and less than about 40 volume % aromatic hydrocarbons.

To prepare a finished naphthenic hydrocarbon based lubricating oil suitable for use as a crank case lubricant for diesel engines, the naphthenic hydrocarbon base stock as described above is blended with a highly viscous "bright stock" to provide the desired viscosity and viscosity index in the lubricant. A suitable additive mixture for a diesel lubricant then will be added. The final product typically will contain at least about 70 volume % of the naphthenic hydrocarbon base stock prepared by the process of the invention.

The raffinate stream recovered via line 26 will be stripped free of furfural before being further processed. The furfural-free stream consists predominately of paraffinic hydrocarbons having viscosities and boiling point ranges typically included in predominately paraffinic lubricating oil base stocks. The raffinate stream is solvent dewaxed to produce automotive lubricating oils for internal combustion engines. Such fractions will have high viscosity indexes.

The overall advantages of the process of the invention are the following. The total overall yield of lubricating oil base stocks from a paraffinic crude is increased. The bulk of the high boiling paraffinic hydrocarbons of the crude are recovered as the raffinate of the solvent extraction step. These paraffinic hydrocarbons can be used as lubricating oil base stocks where the presence of naphthenic hydrocarbons is not considered to be of critical importance. The extracted aromatic hydrocarbons boiling in the lubricating oil range, which normally have low market value, are converted to high market value naphthenic hydrocarbons. These converted naphthenic hydrocarbons are concentrated in lubricating oil base stocks containing at least 50 volume % naphthenic hydrocarbons. The two types of lubricating oil base stocks prepared by the process, if desired, can be blended to prepare lubricating oil base stocks having a wide range of naphthenic hydrocarbon content.

The paraffinic lubricating oil base stocks are well suited for formulation into high viscosity index automotive lubricating oils. The naphthenic lubricating oil base stocks, by reason of their special properties, are customarily formulated into diesel engine lubricating oils, particularly for heavy duty use in railroad and marine diesel engines.

While the process and product herein described constitute preferred embodiments of the invention, it is to be understood that the invention is not limited to this precise process and product, and that changes may be made therein without departing from the scope of the invention which is defined in the appended claims.

What is claimed is:

1. A process for increasing the volume of lubricating oil base stocks recovered from a crude oil and preparing two or more high quality lubricating oil base stocks therefrom, one of which is high in paraffinic hydrocarbons and low in naphthenic hydrocarbons and a second of which is a high quality naphthenic lubricating oil base stock having a viscosity of at least about 200 SUS at 100° F., containing at least about 50 volume % naphthenic hydrocarbons, a maximum of about 10 volume % paraffinic hydrocarbons, a maximum of about 40 volume % aromatic hydrocarbons, and having a pour point of less than about 20° F., which process consists essentially of:

(a) distilling from said crude oil an overhead fraction having an atmospheric boiling point up to about 675° F., (b) vacuum distilling the bottoms fraction from step (a) and recovering one or more overhead cuts having boiling points (corrected to atmospheric pressure) in the range of about 675 to 1100° F., (c) contacting the overhead cuts from step (b) with an immiscible heterocyclic solvent to extract from said overhead cuts a hydrocarbon mixture containing at least about 50 volume % aromatic hydrocarbons, less than about 10 volume % paraffinic hydrocarbons and at least a portion of the naphthenic hydrocarbons originally present in said refinery stream, (d) recovering from step (c) a raffinate which is high in paraffinic hydrocarbons and low in aromatic and naphthenic hydrocarbons, said raffinate having a viscosity and boiling point range such that it meets specifications for a high quality paraffinic lubricating oil base stock, (e) recovering the hydrocarbon mixture from the heterocyclic solvent employed in step (c), (f) hydrotreating the hydrocarbon mixture from step (e) with hydrogen at an elevated temperature under superatmospheric hydrogen pressure in the presence of a hydrogenation catalyst to hydrogenate the aromatic rings of a substantial portion of the aromatic hydrocarbons present therein, (g) treating the product from step (f) with hydrogen under superatmospheric pressure in the presence of a dewaxing catalyst to crack the bulk of the wax-like components present therein, and (h) distilling from the product from step (g) fractions boiling below about 650° F. at atmospheric pressure and recovering a high quality naphthenic lubricating oil base stock having a viscosity of at least about 200 SUS at 100° F., containing at least about 50 volume % naphthenic hydrocarbons, a maximum of about 40 volume % aromatic compounds, a maximum of about 10 volume % of paraffinic hydrocarbons and having a pour point of less than about 20° C.

2. A process of claim 1 in which the immiscible heterocyclic solvent employed in step (c) is furfural, phenol, or N-methyl pyrrolidone.

3. A process of claim 2 in which the immiscible heterocyclic solvent is furfural.

4. A process of claim 2 in which the hydrogenation catalyst employed in step (f) is a cobalt-molybdenum or a nickel-molybdenum catalyst.

5. A process of claim 3 in which the hydrogenation catalyst employed in step (f) is a cobalt-molybdenum or a nickel-molybdenum catalyst.

6. A process of claim 2 in which the dewaxing catalyst employed in step (g) is a noble metal, a Group VI-B metal or a Group VIII metal supported on an acidic zeolite having a high silica-to-alumina mol ratio.

7. A process of claim 6 in which the acidic zeolite has a silica/alumina mole ratio of at least 12 and a pore size in the range of about 2–4 angstroms.

8. A process of claim 3 in which the dewaxing catalyst employed in step (g) is a noble metal, a Group VI-B metal or a Group VIII metal supported on an acidic zeolite having a high silica-to-alumina mol ratio.

9. A process of claim 8 in which the acidic zeolite has a silica/alumina mol ratio of at least 12 and a pore size in the range of about 2–5 angstroms.

10. A process of claim 3 in which the dewaxing catalyst employed in step (g) is a platinum catalyst supported on a hydrogen mordenite whose pores are partially blocked with barium.

11. A process for preparing a high quality lubricating oil base stock having a viscosity in the range of about 700 to 1,000 SUS at 100° F., having a pour point of less than about 20° F., and containing at least about 50 volume % naphthenic hydrocarbons which consists essentially of:

(a) vacuum distilling a reduced crude cut having an atmospheric boiling point greater than about 650° F. and recovering therefrom an overhead fraction having a boiling point range (corrected to atmospheric pressure) of about 675 to 1100° F.

(b) contacting the overhead fraction from step (a) with furfural to extract therefrom a hydrocarbon mixture containing at least about 50 volume % aromatic hydrocarbons, less than about 10 volume % paraffinic hydrocarbons and at least a portion of the naphthenic hydrocarbons originally present in said overhead fraction, (c) recovering the hydrocarbon mixture from the furfural employed in step (b), (d) hydrotreating the hydrocarbon mixture from step (c) with hydrogen at a temperature in the range of about 620 to 750° F under a pressure in the range of about 1500 to 2500 psi at a LHSV in the range of about 0.25 to 1.0 in the presence of cobalt-molybdenum or a nickel-molybdenum catalyst supported on a refractory inorganic oxide, (e) catalytically dewaxing the product of step (d) by treating said product with hydrogen at a temperature in the range of about 500 to 1000° F. under a pressure of about 1000 to 3000 psi at a LHSV of about 0.1 to 10 in the presence of a noble metal, or a Group VI-B metal, or a Group VIII metal supported on an acidic zeolite support, (f) distilling from the product of step (e) materials boiling below about 650° F., and (g) distilling the product from step (f) under vacuum to remove additional low boiling fractions and recovering as a bottoms fraction a lubricating oil base stock having a viscosity of about 700 to 1,000 SUS at 100° F., containing at least about 50 volume % naphthenic hydrocarbons and less than about 40 volume % aromatic hydrocarbons and having a pour point of less than about 20° F.

* * * * *